US006612893B2

(12) United States Patent
Rehkemper et al.

(10) Patent No.: US 6,612,893 B2
(45) Date of Patent: Sep. 2, 2003

(54) TOY AIRPLANE ASSEMBLY HAVING A MICROPROCESSOR FOR ASSISTING FLIGHT

(75) Inventors: Jeffrey G. Rehkemper, Chicago, IL (US); Nicholas Grisolia, Chicago, IL (US); Keith Johnson, Des Plaines, IL (US); Bret Gould, Chicago, IL (US); Alexey Florov, Skokie, IL (US)

(73) Assignee: Spin Master Ltd., Toronto (CA)

( * ) Notice: Subject to any disclaimer, the term of this patent is extended or adjusted under 35 U.S.C. 154(b) by 0 days.

(21) Appl. No.: 10/015,696

(22) Filed: Dec. 17, 2001

(65) Prior Publication Data

US 2003/0040247 A1 Feb. 27, 2003

Related U.S. Application Data

(60) Provisional application No. 60/313,799, filed on Aug. 22, 2001.

(51) Int. Cl.[7] ..... A63H 27/00

(52) U.S. Cl. ..... 446/34; 446/57

(58) Field of Search ..... 446/34, 36, 37–38, 446/61, 462, 484, 454, 255, 57, 58, 211, 220; 244/53 R, 62

(56) References Cited

U.S. PATENT DOCUMENTS

| | | | | |
|---|---|---|---|---|
| 3,796,005 A | * | 3/1974 | Chang et al. | 46/243 |
| 3,957,230 A | | 5/1976 | Boucher et al. | 244/53 |
| 4,194,317 A | | 3/1980 | Kidd | 46/76 |
| 4,198,779 A | | 4/1980 | Kress | 46/78 |
| 4,765,567 A | * | 8/1988 | Gutman et al. | 244/17.11 |
| 5,087,000 A | | 2/1992 | Suto | 244/189 |
| 5,507,455 A | | 4/1996 | Yang | 244/190 |
| 6,257,525 B1 | | 7/2001 | Matlin et al. | 244/153 |

* cited by examiner

*Primary Examiner*—Jacob K. Ackun
*Assistant Examiner*—Jamila Williams
(74) *Attorney, Agent, or Firm*—Marcus R. Mickney; Roylance, Abrams, Berdo & Goodman LLP

(57) ABSTRACT

A toy airplane assembly is provided that is easy to fly, inexpensive, and durable. The toy plane assembly includes a plane having a radio receiver and a microprocessor. Batteries housed in the fuselage power the printed circuit board to which the microprocessor and radio receiver are attached. The radio receiver receives signals from a hand-held remote control radio transmitter and are transmitted to the microprocessor. The microprocessor decodes the signals and, in response thereto, distributes power to the motors for driving the propellers. All movement of the plane is controlled by the microprocessor, thereby providing microprocessor assisted flight. The plane fuselage is a one-piece molded part, made of a foam material to provide a durable plane.

25 Claims, 6 Drawing Sheets

TOY AIRPLANE ASSEMBLY HAVING A MICROPROCESSOR FOR ASSISTING FLIGHT

CROSS-REFERENCE TO RELATED APPLICATION

This application claims the benefit under 35 U.S.C. § 119(e) of provisional application Serial No. 60/313,799, filed Aug. 22, 2001, which is hereby incorporated by reference in its entirety.

FIELD OF THE INVENTION

The present invention relates to toy airplanes. More particularly, the present invention relates to toy airplanes having microprocessors for assisting flight.

BACKGROUND OF THE INVENTION

Existing propeller-driven toy airplanes utilizing radio control usually have single or twin propellers provided on the airframe. The propellers are driven by a motor, an engine or the like, so that the toy plane can be made to fly freely in the air. Existing toy airplanes generally have propellers employed only for driving the airplane. Those airplanes require an elevator or a rudder to direct the airplane upward or downward, or right or left. For such toy airplanes, a control servo and a mechanical mechanism for controlling the elevator and the rudder are necessary, and thereby the airplane is difficult to control and the weight increased. In addition, a driving source for the propellers is required to have a large output, resulting in an increase in the cost of the toy as a whole. Moreover, in respect to such control of the elevator and the rudder, responsiveness to changes in direction and elevation for the radio controlled toy is quite good. The sensitivity of the elevator and rudder to control signals from the radio controller causes the airplane to be extremely difficult to fly. Moreover, such controls require time and practice to master, thereby creating a frustrating experience and increasing the likelihood of a crash for a beginner. Due to the large number of parts in existing toy airplanes, the material used to construct the parts of existing toy airplanes, and the shape of the fuselage of existing toy airplanes, such crashes could cause substantial damage to the plane, thereby creating a frustrating flying experience for a beginner.

Radio controlled airplanes are generally expensive to purchase. Moreover, they require time and practice to learn how to fly the plane successfully. First time flights often end up with disastrous results, thereby frustrating the beginner and lessening the enjoyment of the activity. Additionally, many consumers do not want to spend a lot of time learning the required skills prior to initiating a first successful flight. Therefore, beginners are reluctant to purchase such planes a first time, and even more reluctant to purchase subsequent planes after damaging a plane in a crash. A need exists for a toy airplane assembly that is easy to fly for the beginner, inexpensive to purchase, and durable to survive crashes.

Examples of existing radio controlled toy airplanes are disclosed in the following references: U.S. Pat. No. 3,957,230 to Boucher et al.; U.S. Pat. No. 4,194,317 to Kidd; U.S. Pat. No. 4,198,779 to Kress; U.S. Pat. No. 5,087,000 to Suto; U.S. Pat. No. 5,507,455 to Yang; and U.S. Pat. No. 6,257,525 to Matlin et al.

Thus, there is a continuing need to provide improved toy airplanes.

SUMMARY OF THE INVENTION

The radio controlled (RC) plane assembly of the present invention is easy to fly, inexpensive, and durable. The RC plane assembly includes a plane having a radio receiver for receiving signals and a microprocessor for assisting flight.

The plane fuselage is a one-piece molded part, thereby requiring no assembly by the consumer. The fuselage is made of a foam material, such as EPS or EPP foam, to provide durability to the plane, as well as having lower manufacturing costs than existing toy airplanes. Moreover, the foam material is flexible to withstand the impact of a crash, which occurs frequently for beginning radio controlled plane users, thereby providing a plane having a long life. The fuselage shape is substantially that of a flying wing, thereby providing a high coefficient of lift to the plane to assist in maintaining the plane airborne. Motors drive propellers positioned on the wing on opposite sides of the fuselage. The microprocessor and the radio receiver are attached to a printed circuit board housed in the fuselage. Batteries supply power to the printed circuit board. The radio receiver located in the fuselage receives a signal from the radio transmitter in the hand-held remote control. The signal triggers the microprocessor, which distributes power to the motors for driving the propellers. All movement of the plane is controlled by the microprocessor. The microprocessor assisted flight provides an easy to fly plane that is an enjoyable experience for a beginner.

Batteries supply power to the plane's printed circuit board. Preferably, the batteries are rechargeable. A docking station may be used to recharge rechargeable batteries. Attaching the plane to the docking station recharges the plane batteries. A switch on the base controls the level to which the batteries are recharged. An indicator, such as LED's, on the docking station indicates that the recharge is occurring and/or indicates when the recharge is complete. A timer circuit may be used to avoid overcharging the plane batteries.

The remote control radio transmitter is a hand-held device for sending signals to the radio receiver on a printed circuit board housed in the plane fuselage. In response to the received signal, the radio receiver triggers the microprocessor, which controls distribution of power from the batteries to the motors. Altering the distribution of power to the motors causes the plane to turn right, turn left, climb or descend. The hand-held remote control radio transmitter transmits four signals to the plane: turn right, turn left, turbo (or thrust) and land.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

Referring now to the drawings that form a part of the original disclosure.

DETAILED DESCRIPTION OF THE INVENTION

As shown in FIGS. 1–7, the toy airplane assembly according to the present invention includes a plane 31 having a radio receiver 73 and a microprocessor 71. The airplane assembly provided by the present invention is easy to fly, and is less expensive and more durable than existing toy airplanes.

Figure 1:
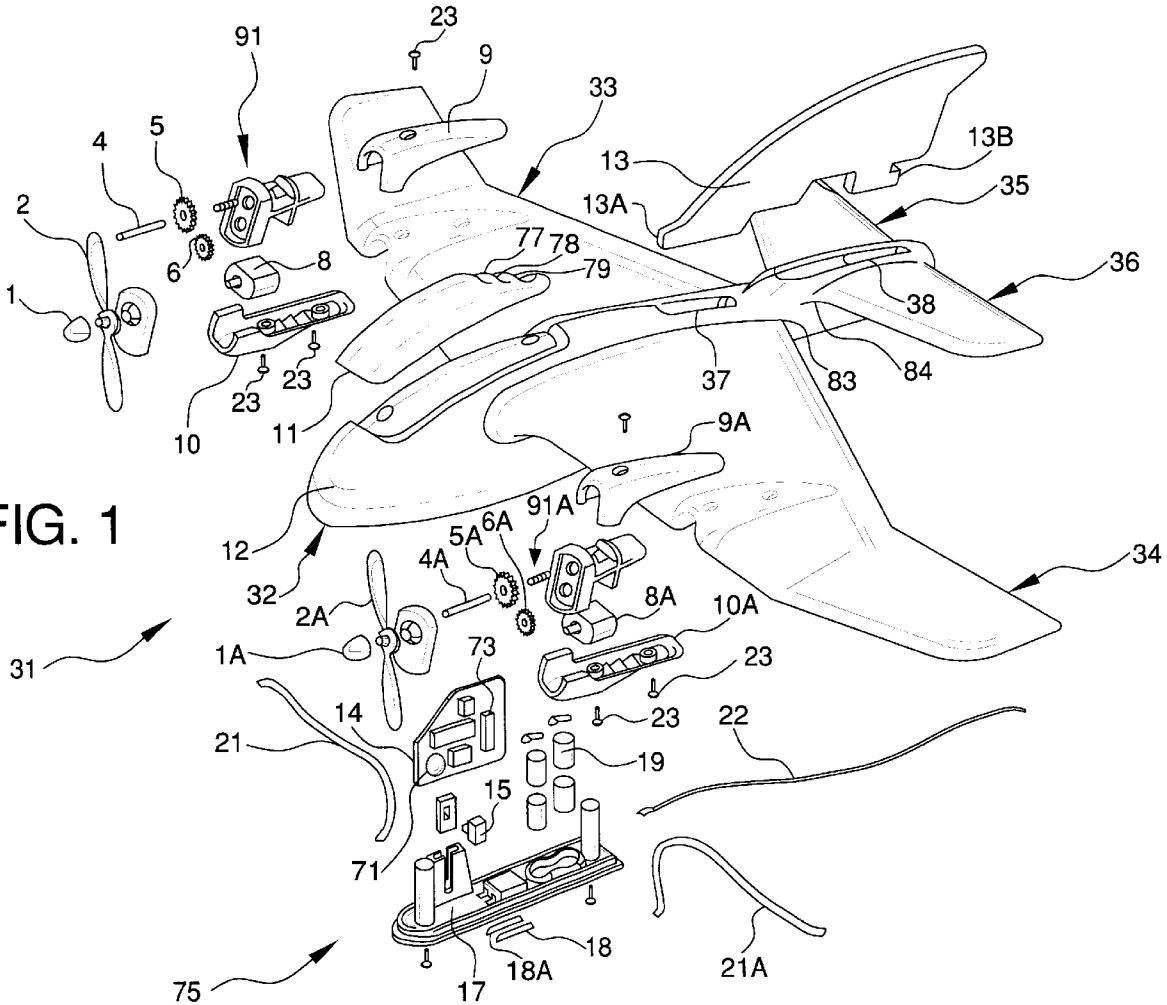
FIG. 1 is an exploded perspective view of a toy airplane assembly according to the present invention.
Figure 2:
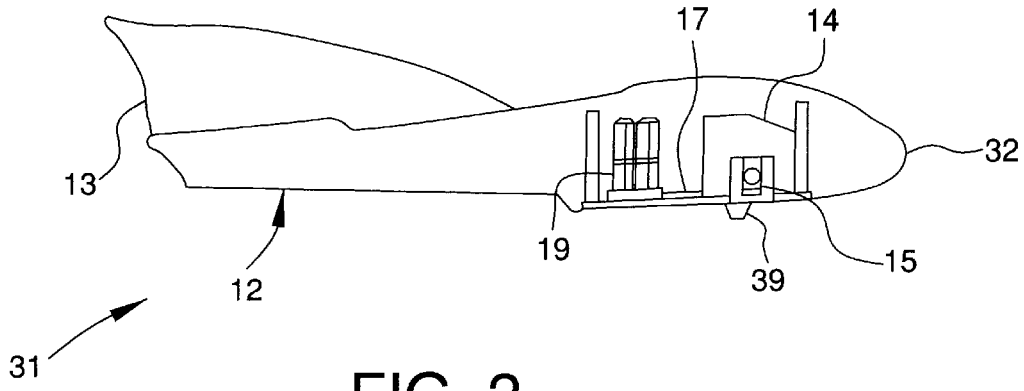
FIG. 2 is a side elevational view in partial cross section of the plane of FIG. 1.
Figure 3:
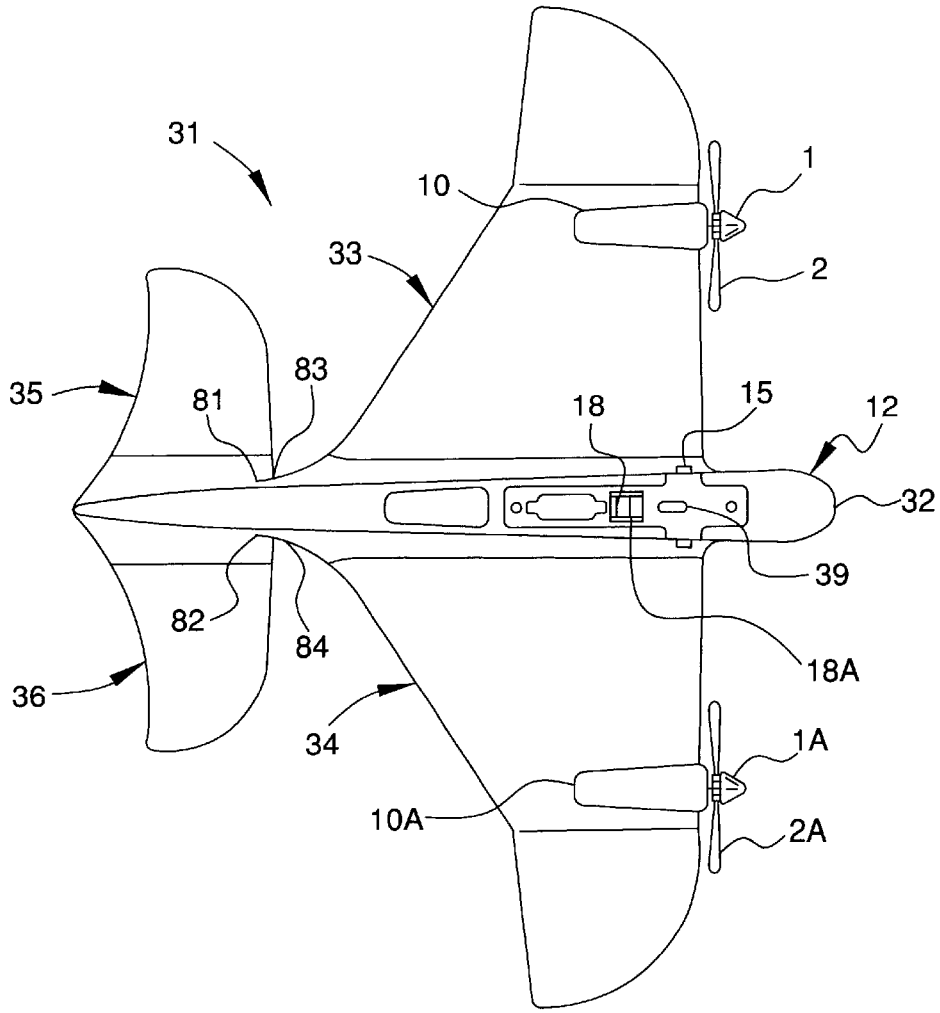
FIG. 3 is a bottom plan view of the plane of FIG. 1.
Figure 7:
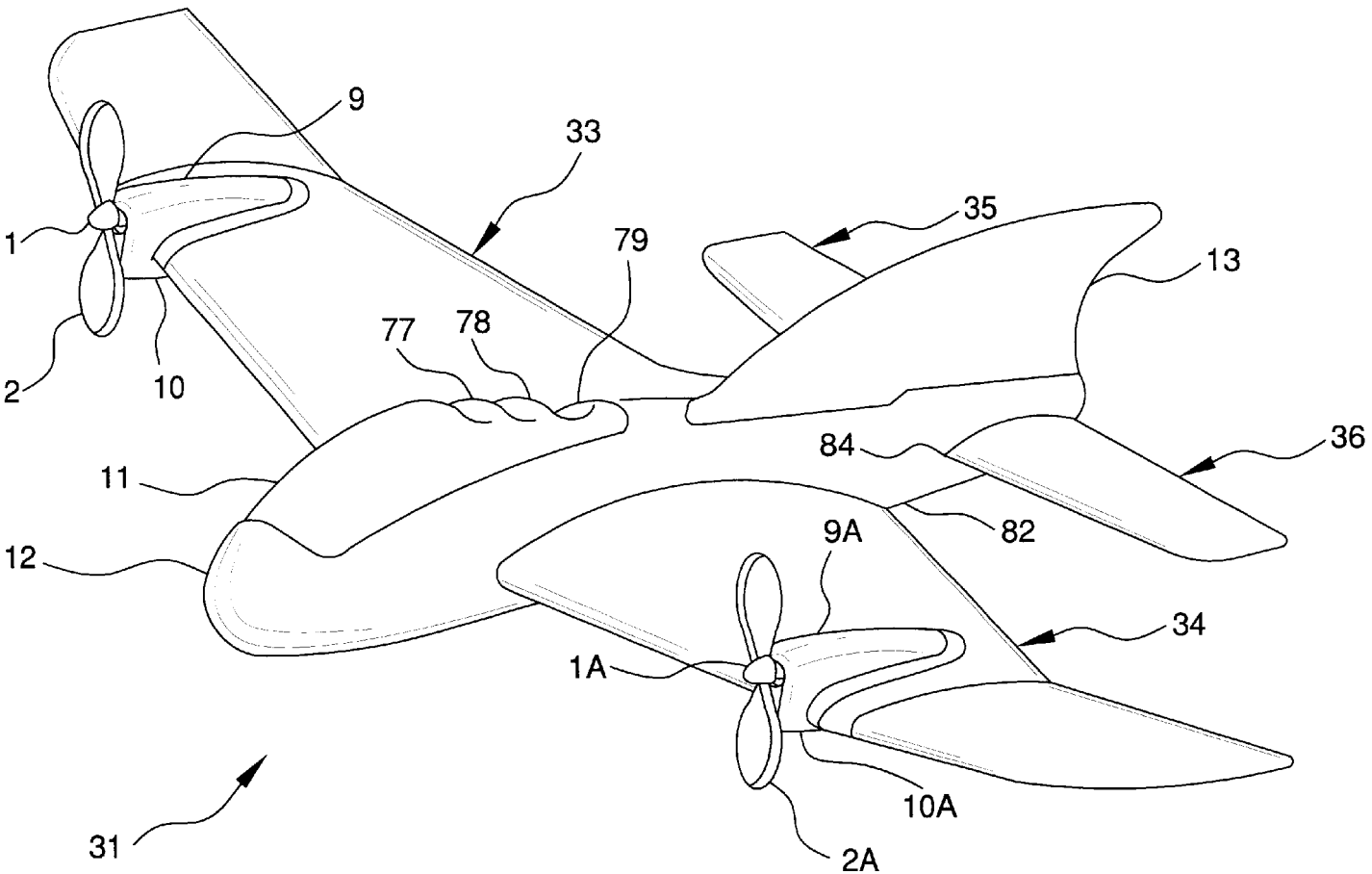
FIG. 7 is a perspective view of the toy airplane assembly of FIG. 1.

As shown in FIGS. 1, 3 and 7, the plane fuselage 12 is a one-piece molded part, thereby requiring no assembly by the user to construct the fuselage. The fuselage 12 is made of a foam material, such as EPS or EPP foam, to provide durability to the plane 31, as well as being less expensive to manufacture than existing planes. The fuselage shape is substantially that of a flying wing, thereby providing a high coefficient of lift to the plane to assist in maintaining the plane airborne, even by a novice user. The fuselage 12 includes the nose 32, first and second main wings 33 and 34, and first and second rear wings 35 and 36. A tail 13 is attached to the fuselage 12 by inserting tabs 13A and 13B into corresponding recesses 37 and 38. Alternatively, a single tab may be used to attach tail 13 to the fuselage 12. The fuselage 12 lacks a shoulder, thereby providing minimal distance between the rear edges of the first and second main wings 33 and 34 and the front edges of the first and second rear wings (stabilizers) 35 and 36. The first and second rear wings 35 and 36 stabilize the plane 31 to provide steady, level flight by creating lift and moments opposing lift and moments created by the weight of the electronics sub-assembly 75 housed in fuselage 12. A rear-most point 81 and 82 of each of the first and second main wings 33 and 34, respectively, is proximal a forward-most point 83 and 84 of each of the first and second rear wings 35 and 36, respectively. Preferably, the rear-most points 81 and 82 are rearward of the forward-most point 83 and 84 of each of the first and second rear wings 35 and 36.

First and second motors 8 and 8A drive first and second propellers 2 and 2A, respectively. First motor 8 and first propeller 2 are positioned on first main wing 33, while second motor 8A and second propeller 2A are positioned on second main wing 34 on an opposite side of fuselage 12, as shown in FIGS. 1 and 7. Caps 1 and 1A are attached to the first and second propellers 2 and 2A to provide aerodynamic flow over the propellers. First and second motors 8 and 8A are mounted on wings 33 and 34 between upper fairings 9 and 9A and lower fairings 10 and 10A, respectively. The fairings have an aerodynamic shape such that mounting the motors to the wings does not add undue drag forces during flight. Screws 23 attach the fairings to the fuselage 12. Drive shafts 4 and 4A connect the first and second motors 8 and 8A to the first and second propellers 2 and 2A for driving the propellers.

Figure 6:
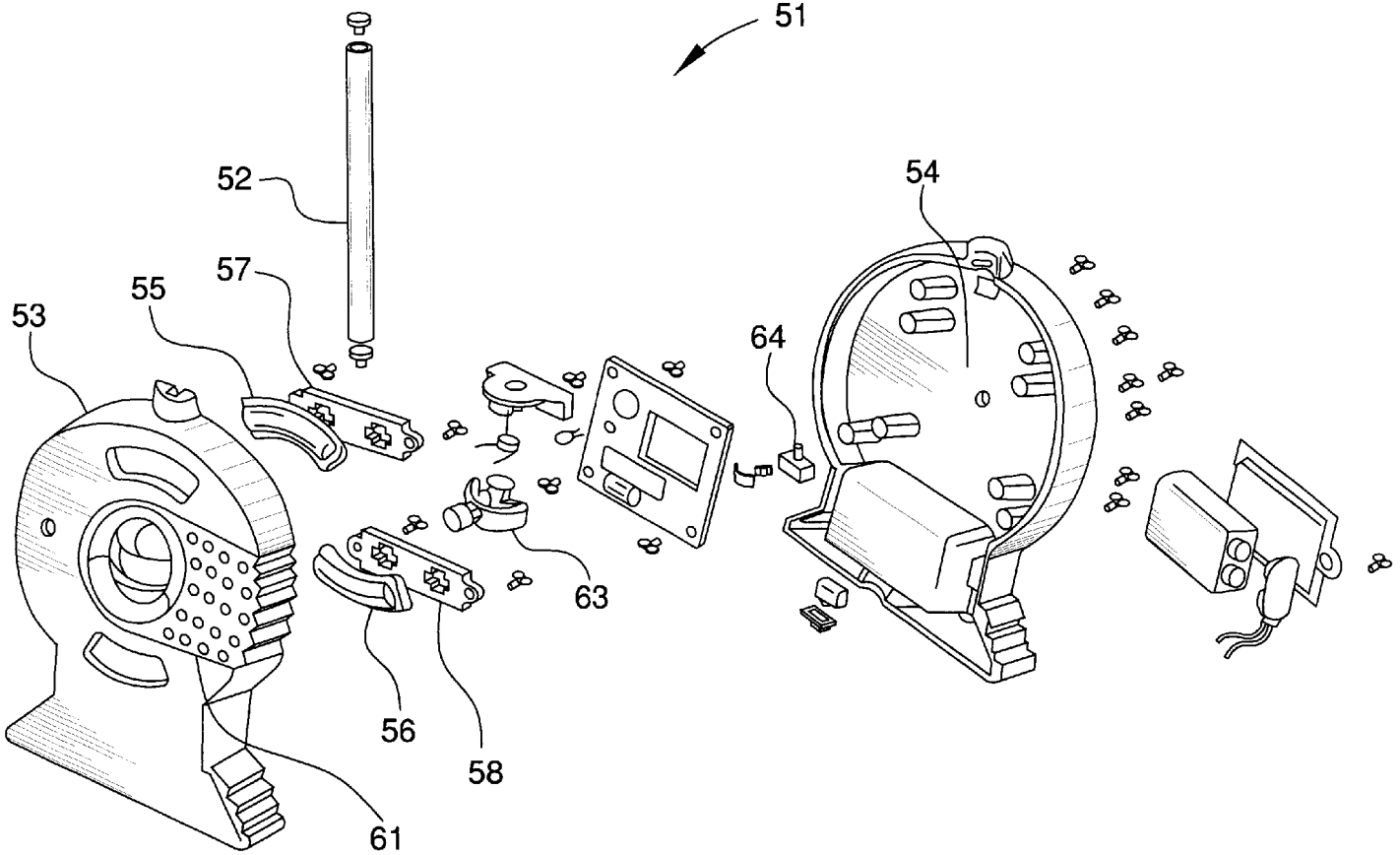
FIG. 6 is a an exploded perspective view of a controller in accordance with the present invention for use with the plane of FIG. 1.

The microprocessor 71 and radio receiver 73 are attached to a printed circuit board 14. Batteries 19 supply power to the printed circuit board 14. A radio receiver 73 on the printed circuit board 14 housed within the fuselage 12 receives a signal transmitted by the hand-held remote control radio transmitter (FIG. 6). Antenna 22 housed in the fuselage 12 facilitates reception of the transmitted radio signal by the radio receiver 73. The received signal is sent to the microprocessor 71, where the signal is decoded into the flight instructions sent by the user with the handheld remote control radio transmitter. In response to the decoded signal, the microprocessor distributes power to the first and second motors 8 and 8A for driving the first and second propellers 2 and 2A. The relationship between the motor and propeller speeds is controlled by gear trains 91, comprising first gears 5 and 5A and second gears 6 and 6A. The gear train relationship is approximately 3:1, i.e., for every 3 rotations of the motor the propeller rotates once. Preferably, the gear train relationship is 2.66:1. The printed circuit board 14 is mounted on mounting plate 17 housed in the fuselage 12. Batteries 19 are also housed on the mounting plate 17.

Power is supplied by batteries 19 to the printed circuit board 17 to which the microprocessor 71 and radio receiver 73 are attached. Preferably, the batteries 19 are rechargeable batteries. Power wires 21 and 21A distribute power from the microprocessor 71 to the first and second motors 8 and 8A. Contacts 18 and 18A mounted to the mounting plate 17 provide a mechanical and an electrical connection between the plane 31 and the docking station 41 for recharging the batteries 19. The fuselage 12 may have a venting system to cool the batteries 19, such as vents 77, 78 and 79 in the canopy 11.

Figure 4:
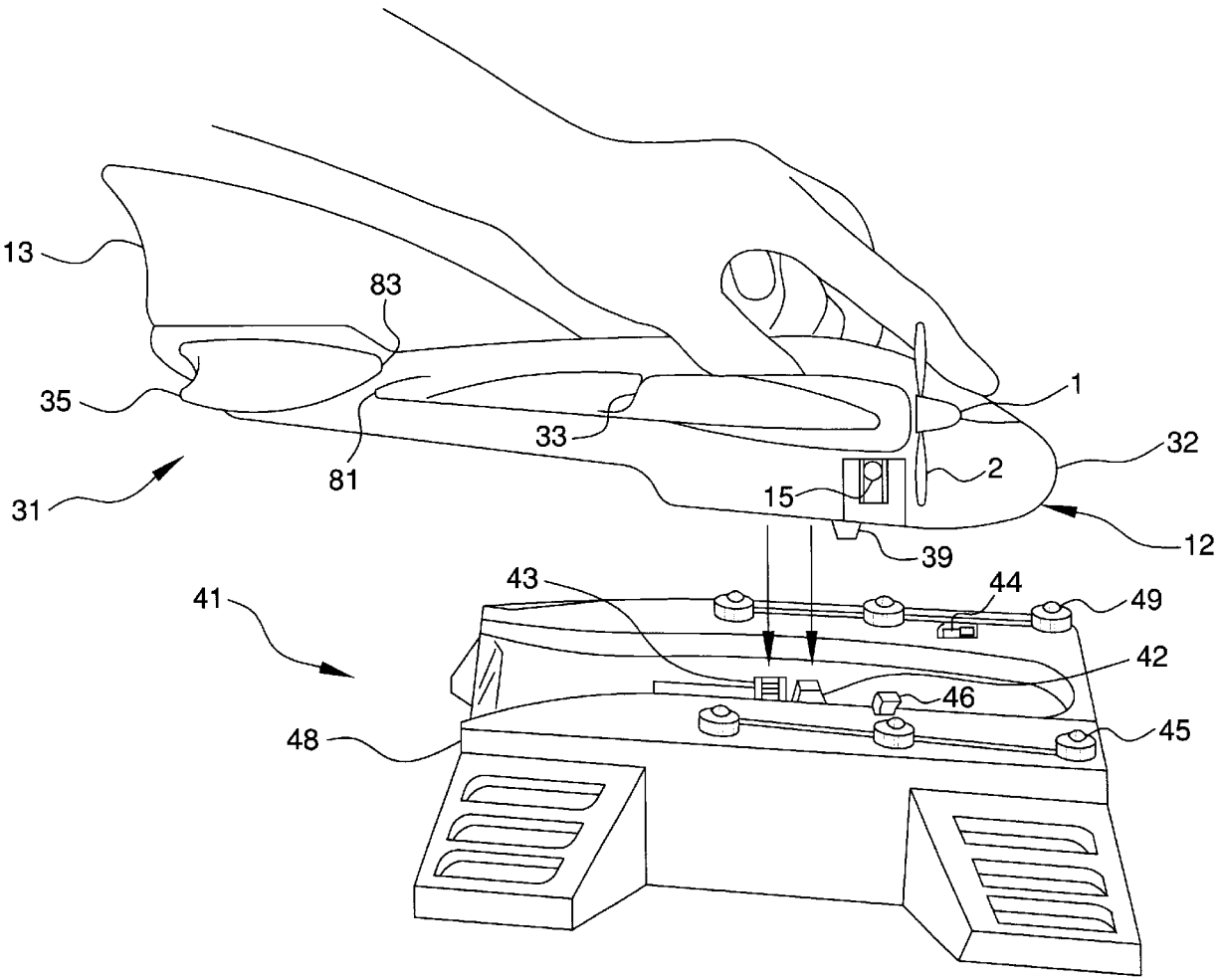
FIG. 4 is a perspective view of the plane and charger of FIGS. 1 and 5.
Figure 5:
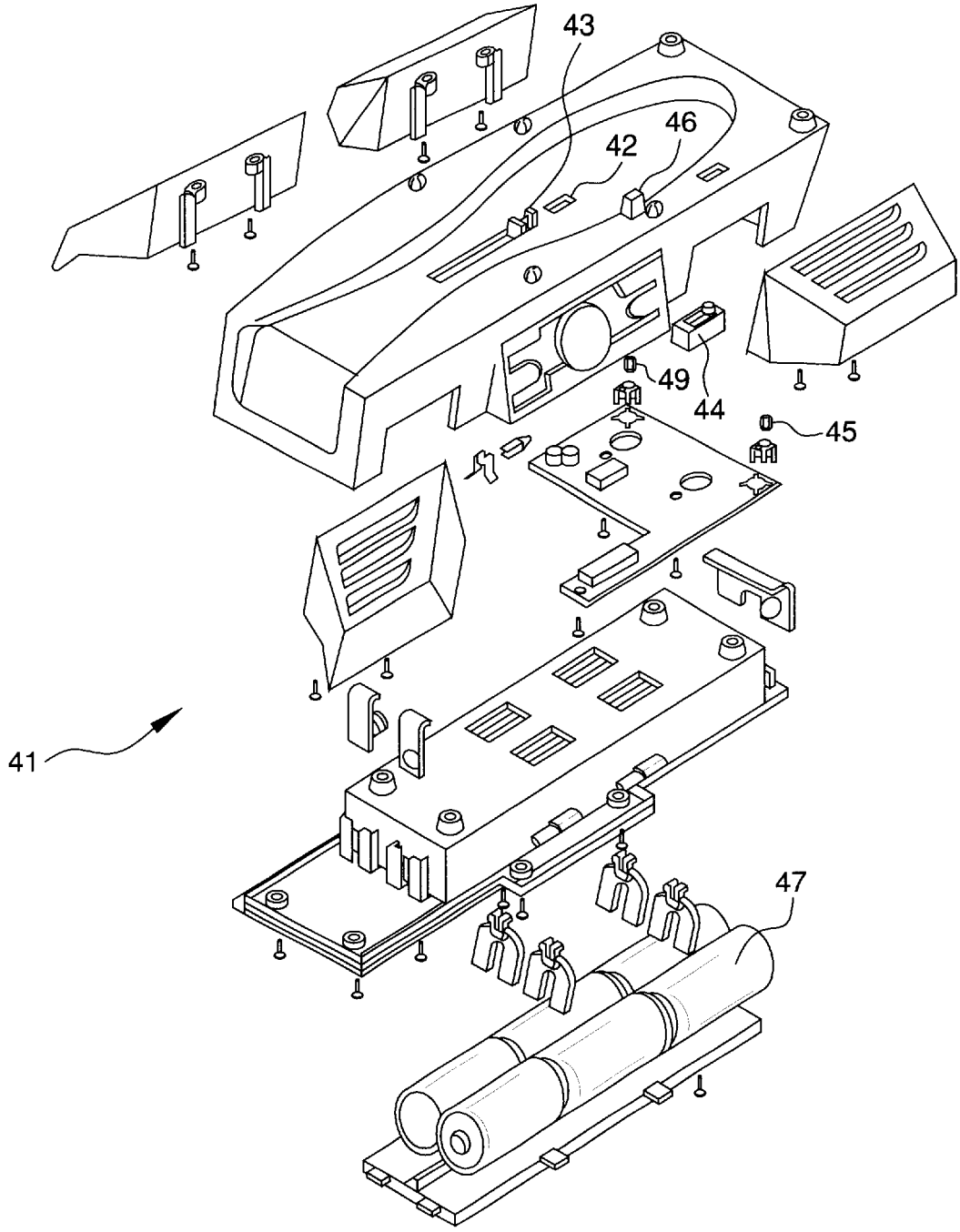
FIG. 5 is an exploded perspective view of a charging base in accordance with the present invention for use with the plane of FIG. 1.

The docking station 41, as shown in FIGS. 4 and 5, recharges the batteries 19 that power the printed circuit board 14. Alignment tab 39 on the fuselage 12 is received by the alignment port 42 in the housing 48 of the docking station 41 to provide a mechanical connection and alignment between the plane and docking station. The contacts 18 and 18A engage the docking rod 43 on the housing 48 of the docking station 41 to provide a mechanical and an electrical connection between the docking station and the plane 31.

First switch 15 is a three-position switch on the plane set to the charging position to begin recharging the batteries 19 (the other two positions being the beginner and advanced flight modes). Alternatively, tab 46 on the docking station may be located such that engaging the plane with the docking station 41 causes the tab to push the three-position switch 15 into the charging position, so that recharging is automatic upon engaging the plane 31 with the docking station. Second switch 44 on the docking station is a three-position switch having an off position, a low charge level position and a high charge level position. The high charge level is for charging the batteries to higher level for longer flight times, while the low charge level is for charging the batteries to a lesser level so that a user must not wait as long to fly the plane again. First and second LED's 45 and 49, respectively, on the docking station 41 indicate the status of the recharge. For example, first LED 45 may flash to indicate that the batteries are in the process of being recharged. When recharging to the selected level is complete, the first LED 45 turns off and the second LED 49 turns on solid to indicate that the recharge process is complete. Any LED indicators may be used to indicate the recharge status, e.g., a single LED that flashes during recharging and turns solid when recharging is complete, or LED's that change colors to indicate the status of the recharging. A timer circuit may be included with the docking station 41 to ensure that a predetermined charging level is never exceeded to preserve the plane batteries 19 and to ensure that the plane batteries are never overcharged.

The docking station shown in FIG. 5 is powered by batteries 47. This provides a docking station 41 that may be taken anywhere to recharge the RC plane's batteries 19. Alternatively, the docking station 41 may have a power cord for connecting to a power supply, such as a standard wall outlet, to recharge a plane 31.

The hand-held remote control radio transmitter 51, as shown in FIG. 6, is used to send flying instructions to the plane 31 while in flight. The electronics of the hand-held remote control radio transmitter 51 are contained within the front housing 53 and the rear housing 54. A pad 61 may be located on the front housing 53 to facilitate a user's grip on the hand-held remote control radio transmitter 51 during use.

The hand-held remote control radio transmitter 51 sends four different function signals to the plane 31. Any number of channels may be used, but the less channels used the less expensive the radio transmitter. The four function signals are right turn, left turn, turbo (or thrust) and land. The left turn and right turn signals are sent by moving joystick 63 on the hand-held remote control radio transmitter 51. Joystick 63 activates the third switch 64 that triggers the left or right turn signal to be sent to the microprocessor 71. Button 55 controls third switch 57 that triggers the turbo signal to be sent, while button 56 controls fourth switch 58 that triggers the landing signal to be sent. All movement of the plane 31 in flight is controlled by the microprocessor 71, thereby providing a plane that is easy to fly.

To accomplish a right turn, the right (first) motor 8 is run at a speed less than that of the left (second) motor 8A. To accomplish a left turn, the left motor 8A is run at a speed less than that of the right motor 8. All turns are accomplished by the microprocessor 71 controlling the motor speeds by controlling the amount of current supplied to each motor, which is accomplished by pulse width modulation, i.e., turning the motor on and off with a certain ratio of on to off. Turbo (or thrust) increases speed and altitude by running both motors at full speed. Landing mode involves microprocessor controlled pulsing of both motors at a predetermined slow speed, which causes the plane to enter a gradual descent. Pulsing of the motors 8 and 8A allows for longer life of the plane's batteries 19. Additionally, pulsing the motors allows turns to be accomplished so that additional flaps, ailerons, etc. may be eliminated from the fuselage, thereby allowing for the one-piece fuselage of the present invention. The plane microprocessor 71 is programmed to pulse the first and second motors 8 and 8A for a predetermined length of time to accomplish a turn in response to a hand-held remote control radio transmitter, thereby preventing a user from oversteering the plane into a dive.

The plane 31 has a three-position switch 15 that is used to set the plane in either a beginner or an advanced mode. In the beginner mode, the microprocessor 14 is programmed to control the pulsing of the first and second motors 8 and 8A so that the difference in motor powers between the left (second) and right (first) motors to accomplish a turn is not too large and the motors are run at that power difference level for a time sufficient to cause the plane to make a gradual turn. In the advanced mode, the power difference between left and right motors is greater than in the beginner mode when making a turn, and that power difference level is maintained for a shorter duration than in the beginner mode. The advanced mode provides quicker, more "snappy" turns than in the beginner mode. The third switch position is the "off" mode, which is also the position used to recharge batteries of a plane having rechargeable batteries.

The plane 31 is launched simply by throwing it in the air. The plane microprocessor 14 is programmed to run the first and second motors at full speed (turbo mode) for a predetermined amount of time (e.g., five seconds) once the switch 15 is set to the desired flying mode (beginner or advanced). This provides a reliable and easy launch by the user. If the batteries lose power during flight or are unable to provide power to the motors, the shape of the main wings 33 and 34 provides gliding capabilities to the plane. The gliding capability of the plane prevents damage of the plane caused by a crash due to loss of power, thereby providing a plane having a long life even when used by a beginner. The automatic landing mode also avoids crashing of the plane by a user due to inexperience. The landing mode brings the plane in at a controlled descent by a microprocessor controlled reduction of the motor power.

The microprocessor 71 may be programmed to have an "out of range" feature, i.e., if a command is not received by the plane for a predetermined amount of time from the radio transmitter 51, the microprocessor causes the plane to enter the landing mode. The microprocessor 71 may also be programmed so that when the plane is in landing mode further commands may be sent to take the plane out of landing mode, or so that once in landing mode the plane is not able to be taken out of landing mode.

In another embodiment, the microprocessor 14 is programmable such that there is no need for a hand-held remote control radio transmitter. The microprocessor 14 is programmed prior to a flight with a flight pattern. The microprocessor 14 then automatically runs the plane through the programmed pattern during the flight. The microprocessor may have several pre-programmed flight patterns such that a user may select from a variety of pre-programmed patterns. Alternatively, a flight pattern may be entirely programmed by the user prior to a flight. The microprocessor then follows the user-programmed pattern during the flight.

While advantageous embodiments have been chosen to illustrate the invention, it will be understood by those skilled in the art that various changes and modifications may be made therein without departing from the scope of the invention as defined in the appended claims.

What is claimed is:

1. A toy airplane assembly, comprising:

a fuselage having first and second main wings and a tail;

first and second motors connected to said first and second main wings, respectively;

first and second propellers connected to and driven by said first and second motors, respectively;

a battery housed in said fuselage;

a circuit board housed in said fuselage and connected to said battery; and a microprocessor housed in said fuselage and connected to said circuit board for controlling said first and second motors to control flight of the toy airplane assembly.

2. A toy airplane assembly according to claim 1, wherein first and second rear wings are attached to said fuselage.

3. A toy airplane assembly according to claim 2, wherein a rear-most point of each of said first and second main wings is proximal a forward-most point of each of said first and second rear wings.

4. A toy airplane assembly according to claim 3, wherein said rear-most points are rearward of said forward-most points.

5. A toy airplane assembly according to claim 1, wherein said battery is rechargeable.

6. A toy airplane assembly according to claim 1, wherein said fuselage is foam.

7. A toy airplane assembly according to claim 1, wherein said fuselage is selected from the group consisting of EPS and EPP foam.

8. A toy airplane assembly according to claim 1, wherein a transmitter transmits a signal corresponding to a flight maneuver; and a radio receiver housed in said fuselage and connected to said circuit board receives said transmitter signal and sends said signal to said microprocessor.

9. A toy airplane assembly according to claim 1, wherein a first switch connected to said microprocessor adjusts control of said first and second motors by said microprocessor.

10. A toy airplane assembly according to claim 5, wherein a docking station recharges said battery.

11. A toy airplane assembly according to claim 10, wherein a second switch connected to said docking station controls a recharge level of said battery.

12. A toy airplane assembly according to claim 1, wherein said fuselage, said first and second main wings, and said first and second rear wings are integrally connected.

13. A toy airplane assembly according to claim 8, wherein an antenna is connected to said receiver and housed in said fuselage to facilitate reception of said transmitter signal by said receiver.

14. A toy airplane assembly according to claim 1, wherein said fuselage has a vent for cooling said battery with air during flight.

15. A toy airplane assembly according to claim 10, wherein a first switch connected to said microprocessor adjusts control of said first and second motors by said microprocessor; and a tab on said docking station engages said first switch when said toy airplane is attached to said docking station and moves said first switch to a battery charging position.

16. A toy airplane assembly according to claim 1, wherein first and second gears are connected between said first motor and said first propeller and between second motor and second propeller.

17. A toy airplane assembly according to claim 16, wherein said first and second gears have a motor to propeller ratio of approximately 2.66 to 1.

18. A method of flying a toy airplane, comprising:

(a) supplying first and second currents from a microprocessor stored in a fuselage of the toy airplane to first and second motors, respectively, the first and second currents corresponding to a maneuver to be performed by the toy airplane;

(b) powering the first and second motors in response to the received first and second currents, respectively;

(c) driving first and second propellers with the first and second motors, respectively, in response to the first and second currents causing the toy airplane to perform the maneuver; and (d) repeating steps (a) through (c) to control flight of the toy airplane.

19. A method of flying a toy airplane according to claim 18, further comprising preprogramming the microprocessor with a flight pattern having at least one maneuver, and executing the preprogrammed flight pattern during flight of the toy airplane to repeatedly generate the first and second currents to control flight of the toy airplane.

20. A method of flying a toy airplane according to claim 19, wherein preprogramming the microprocessor with a flight pattern having at least one maneuver comprises preprogramming the microprocessor with at least two flight patterns; and selecting a flight pattern to be executed.

21. A method of flying a toy airplane according to claim 18, further comprising sending a signal from a transmitter to the microprocessor, the signal corresponding to a maneuver to be performed by the toy airplane;

decoding the signal with the microprocessor; and supplying the first and second currents in response to the decoded signal.

22. A method of flying a toy airplane according to claim 21, further comprising supplying the first and second currents when the toy airplane has not received the signal from the transmitter for a predetermined amount of time.

23. A method of flying a toy airplane according to claim 22, wherein supplying the first and second currents comprises supplying first and second currents to land the toy airplane.

24. A method of flying a toy airplane according to claim 21, further comprising supplying the first and second currents when the toy airplane has reached a predetermined distance from the transmitter.

25. A method of flying a toy airplane according to claim 18, further comprising selecting a control level with a switch on the toy airplane, wherein said control level controls the amount of the first and second currents supplied to the first and second motors.

* * * * *